US008858272B2

(12) United States Patent
Hau et al.

(10) Patent No.: US 8,858,272 B2
(45) Date of Patent: Oct. 14, 2014

(54) HIGH CURRENT CONTACT AND CORRESPONDING METHOD FOR PRODUCING A HIGH CURRENT CONTACT ASSEMBLY

(75) Inventors: Wolfgang Hau, Metzingen (DE); Achim Silberbauer, Reutlingen (DE); Adolf Dillmann, Muensingen (DE); Stefan Huehner, Kusterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 215 days.

(21) Appl. No.: 13/515,049

(22) PCT Filed: Nov. 24, 2010

(86) PCT No.: PCT/EP2010/068095
§ 371 (c)(1),
(2), (4) Date: Oct. 8, 2012

(87) PCT Pub. No.: WO2011/069823
PCT Pub. Date: Jun. 16, 2011

(65) Prior Publication Data

US 2013/0035005 A1 Feb. 7, 2013

(30) Foreign Application Priority Data

Dec. 10, 2009 (DE) ..... 10 2009 047 763

(51) Int. Cl.

| | |
|---|---|
| ***H01R 4/48*** | (2006.01) |
| ***H01R 4/58*** | (2006.01) |
| ***H01R 13/187*** | (2006.01) |
| ***H01R 13/05*** | (2006.01) |

(52) U.S. Cl.
CPC .. *H01R 4/58* (2013.01); *H01R 4/48* (2013.01); *H01R 13/187* (2013.01); *H01R 13/05* (2013.01)
USPC ..... 439/834; 439/881

(58) Field of Classification Search
USPC ..... 439/834, 881, 883, 251
See application file for complete search history.

(56) References Cited

U.S. PATENT DOCUMENTS

| | | | |
|---|---|---|---|
| 3,375,749 | A | 4/1968 | Coldren et al. |
| 3,792,412 | A | 2/1974 | Madden |

(Continued)

FOREIGN PATENT DOCUMENTS

| | | |
|---|---|---|
| DE | 19913101 | 10/2000 |
| DE | 10149574 | 4/2003 |
| DE | 102005062709 | 7/2007 |

(Continued)

OTHER PUBLICATIONS

PCT/EP2010/068095 International Search Report dated Jan. 28, 2011 (Translation and Original, 4 pages).

*Primary Examiner* — Hae Moon Hyeon
(74) *Attorney, Agent, or Firm* — Michael Best & Friedrich LLP

(57) ABSTRACT

The invention relates to a high current contact having a contact pin, which has at least one contact opening, and a contact terminal, which has at least one contact limb, wherein the at least one contact limb of the contact terminal is connected to a corresponding contact opening of the contact pin on at least one joint region to produce an electrical contact and to receive mechanical forces, and to a corresponding method for producing said high current contact. According to the invention, producing the electrical contact between the contact pin and the contact terminal is largely separate from the receiving of mechanical forces, wherein the electrical contact between the contact pin and the contact terminal is produced by a first connection type and the mechanical forces are received by a second connection type.

8 Claims, 7 Drawing Sheets

(56) References Cited

U.S. PATENT DOCUMENTS

| | | | | |
|---|---|---|---|---|
| 4,810,213 | A | 3/1989 | Chabot | |
| 4,995,818 | A | 2/1991 | Saimoto | |
| 5,545,842 | A | 8/1996 | Balsells | |
| 5,637,020 | A * | 6/1997 | Ito | 439/699.2 |
| 7,462,080 | B2 * | 12/2008 | Shiraishi et al. | 439/852 |
| 2008/0083553 | A1 | 4/2008 | Gaertner | |

FOREIGN PATENT DOCUMENTS

| | | |
|---|---|---|
| EP | 0735628 | 10/1996 |
| JP | 2004022274 | 1/2004 |
| WO | 2006051014 | 5/2006 |

* cited by examiner

HIGH CURRENT CONTACT AND CORRESPONDING METHOD FOR PRODUCING A HIGH CURRENT CONTACT ASSEMBLY

BACKGROUND OF THE INVENTION

The invention relates to a high current contact and to a corresponding method for producing such a high current contact.

In the field of power electronics, electrical high current contacts between electrical components such as bus bars, high current modules, plugs, capacitors or coils are made by means of screw connections, welded joints, crimping, clinching or spring contacts.

In the European Parliament patent publication EP 0 735 628 B1, a bus bar is, for example, described which has a connecting pin for electrical connectors that is perpendicularly oriented with respect to the plane of one of the main surfaces of said connecting pin. In so doing, the connecting pin is inserted into a receiving aperture, which is provided in the center of the main surface of the bus bar, and is permanently attached to said bus bar, for example by welding, wherein the connecting pin has seating shoulders, which after insertion sit in a positive-locking manner on the surface of said bus bar.

The known contacting and joining methods have restrictions in the selection of material for the partners to be contacted with regard to the alloy compositions, the material pairings, the strengths, the conductivities and the surfaces of said partners. For that reason, the possible material pairings for the contact partners are restricted. In addition, large clearances are required for the joining tools as, for example, welding tongs, TOX tools, clinching tools, laser beam shadows, which prevent a miniaturization of the high current contact.

SUMMARY OF THE INVENTION

The inventive high current contact has in contrast to prior art the advantage that producing an electrical contact between a contact pin and a contact terminal is largely separate from the receiving of mechanical forces, wherein the electrical contact between the contact pin and the contact terminal is produced by a first connection type and the mechanical forces are received by a second connection type. In so doing, at least one contact limb of the contact terminal is connected to a corresponding contact opening of the contact pin on at least one joint region to produce an electrical contact and to receive mechanical forces.

The inventive high current contact can, for example, be used in pulse width modulated inverters for hybrid drives, DC to DC converters and control devices for wind power systems, solar energy systems and fuel cells.

The method according to the invention for producing a high current contact from a contact pin having at least one contact opening and a contact terminal comprising at least one contact limb has in contrast to prior art the advantage that producing the electrical contact between the contact pin and the contact terminal is largely separate from the receiving of mechanical forces, wherein the electrical contact between said contact pin and said contact terminal is produced substantially by a first connection type and the mechanical forces are substantially received by a second connection type.

Embodiments of the invention advantageously separate the functions of electrical contacting and the receiving of mechanical loads and advantageously facilitate the electrical contacting on the joint region via a large cable cross section while using highly conductive metal materials, such as, for example, highly purified copper, silver or aluminum materials or the highly conductive alloys thereof. In terms of processes, there is advantageously no restriction in the selection of the material partners and the surfaces thereof. The electrical contact is, for example, produced via a pressure contact, which results by way of a plastic deformation of the components to be contacted. The mechanical forces are, for example, received by a spring unit which is designed such that no inadmissible relative motions occur between the electrical contact partners.

It is particularly advantageous that the electrical contact between the contact pin and the contact terminal is produced by a pressure contact between the at least one contact opening of the contact pin and the at least one contact limb of the contact terminal, whereby the pressure contact can be produced via plastic deformations of the contact opening and/or the contact limb. The at least one contact limb comprises, for example, in each case a plastically deformable seating shoulder on two sides, said seating shoulder being supported in each case on the contact pin at a corresponding plastically deformable supporting surface. In addition, the at least one contact limb can have in each case a plastically deformable first contact surface on two sides, said first contact surface interacting in each case with a corresponding plastically deformable second contact surface of the contact opening. This facilitates a simple production of the electrical contact having any desired material combinations on the at least one contact limb or respectively on the at least one contact opening.

The geometry and/or material and/or material thickness of the plastically deformable components can be advantageously adapted to an electric current to be transmitted. The contact terminal can thus, for example, have two contact limbs in a fork shape, which are press fit at a right angle into two corresponding contact openings, wherein a splitting effect of the fork-shaped contact limbs can additionally be used to produce the electrical contact.

In a further embodiment of the high current contact according to the invention, a spring unit, which comprises at least one base body having at least one spring element, is inserted into the at least one contact opening of the contact pin for the purpose of receiving mechanical forces. The spring unit comprises advantageously several spring elements. The spring unit can, for example, be embodied such that at least a first spring element is embodied as a support member, which advantageously prevents the inserted spring unit from drawing back out of the contact opening. In addition, the spring unit can be embodied such that at least a second spring element grips into at least one contact surface of the contact limb when press fitting the at least one contact limb into the contact opening and thus advantageously prevents said at least one contact limb of the contact terminal from inadmissibly drawing back out of the at least one contact opening of the contact pin. By means of the spring unit, the inventive high current contact is advantageously in position to receive high mechanical loads, which, for example, result from thermal linear expansion or from vibrational loads. In addition, embodiments of the invention are suitable for "blind joining" and require only small clearances for receiving force during joining.

In one embodiment of the method according to the invention, a spring unit, which comprises at least one base body having at least one spring element, is inserted into the at least one contact opening for the purpose of receiving mechanical forces, wherein the electrical contact between the contact pin and the contact terminal is produced by a pressure contact between the at least one contact opening of the contact pin and the at least one contact limb of the contact terminal.

Advantageous embodiments of the invention are depicted in the drawings and are described below. In the drawings, the same reference numerals denote components or elements, which execute the same or analogous functions.

DETAILED DESCRIPTION

Figure 1:
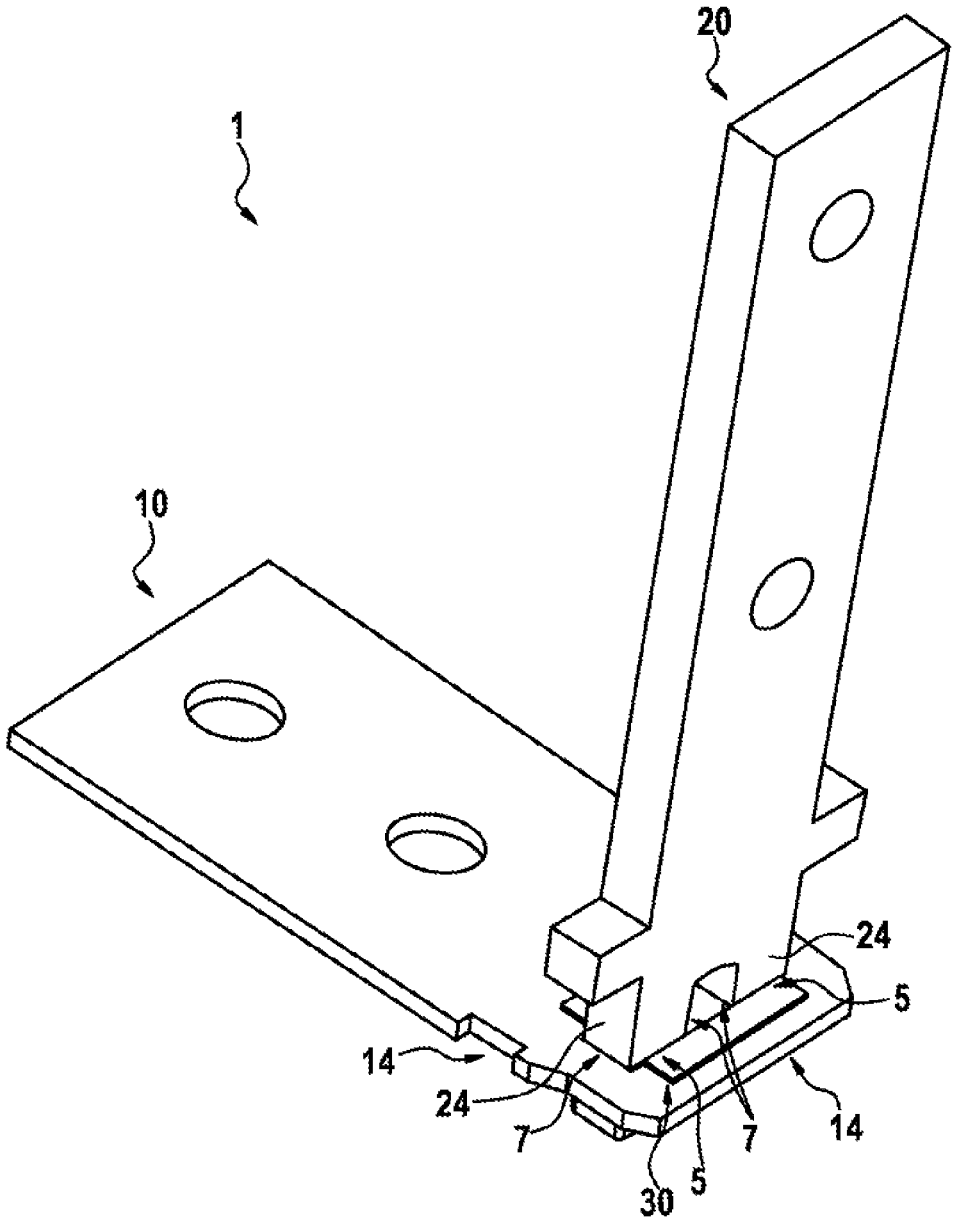
FIG. 1 shows a schematic perspective view of an exemplary embodiment of a high current contact according to the invention.

As can be seen in FIGS. 1 to 7, the depicted exemplary embodiment of a high current contact 1 comprises a contact pin 10, which has two contact openings 15 in the depicted exemplary embodiment, a contact terminal 20, which has two contact limbs 24 in the depicted exemplary embodiment, and a spring unit 30, which comprises in the depicted exemplary embodiment two base bodies 32 having several spring elements 33, 34. As can further be seen in FIGS. 1 and 7, the two contact limbs 24 of the contact terminal 20 are connected to corresponding joint regions 14 having corresponding contact openings 15 of the contact pin 10 to produce an electrical contact and to receive mechanical forces. According to the invention, producing the electrical contact between the contact pin 10 and the contact terminal 20 is largely separate from the receiving of mechanical forces, wherein the electrical contact between said contact pin 10 and said contact terminal 20 is produced by a first connection type (e.g., pressure contact 7) and the mechanical forces are received by a second connection type (5).

As can further be seen in FIGS. 1 and 5 to 7, the spring unit 30 for receiving mechanical forces is inserted into the at least one contact opening 15. In this case, the spring unit 30 is designed such that at least a first spring element 34 is embodied as a support member, which prevents the inserted spring unit 30 from drawing back out of the contact opening 15. In addition, at least one second spring element 33 grips into at least one contact surface 29 of the contact limb 24 when press fitting the at least one contact limb 24 into the contact opening 15. Furthermore, the electrical contact between the contact pin 10 and the contact terminal 20 is produced by a pressure contact 7 between the contact openings 15 of the contact pin 10 and the contact limbs 24 of the contact terminal 20, wherein the pressure contact 7 is produced via plastic deformations of the contact opening 15 and/or the contact limb 24.

Figure 2:
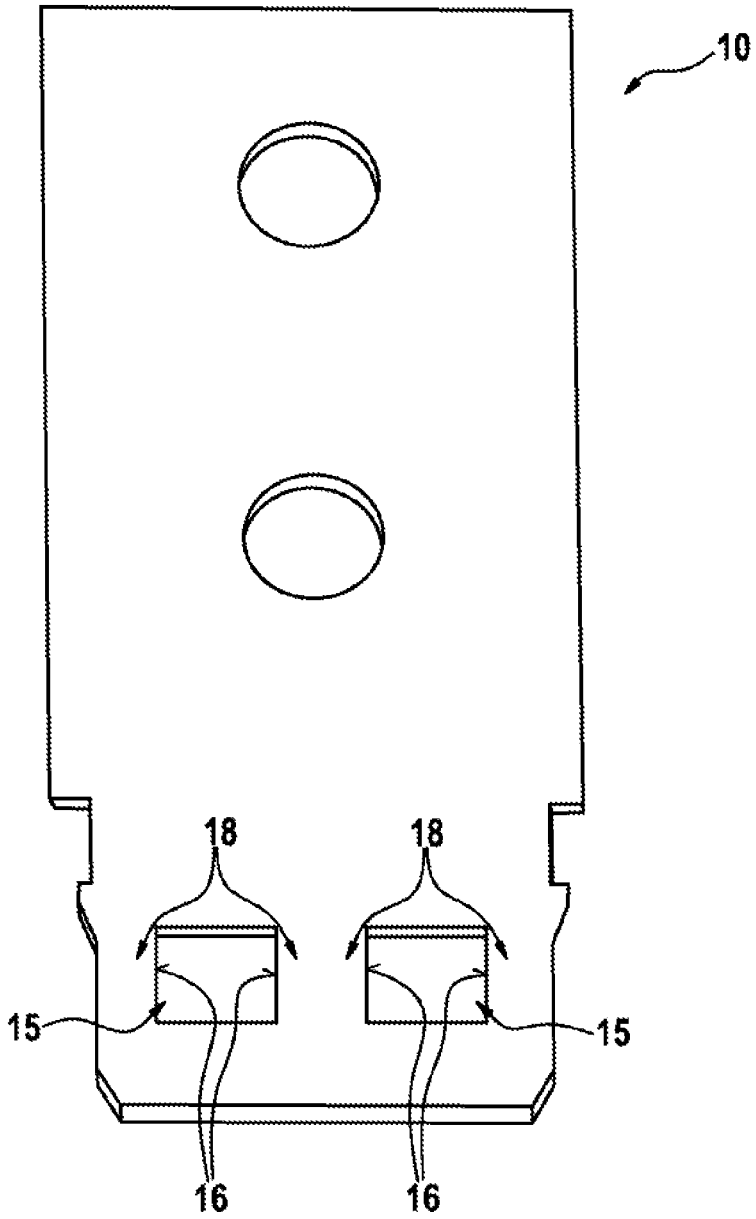
FIG. 2 shows a schematic perspective view of an exemplary embodiment of a contact pin for the inventive high current contact pursuant to FIG. 1.
Figure 3:
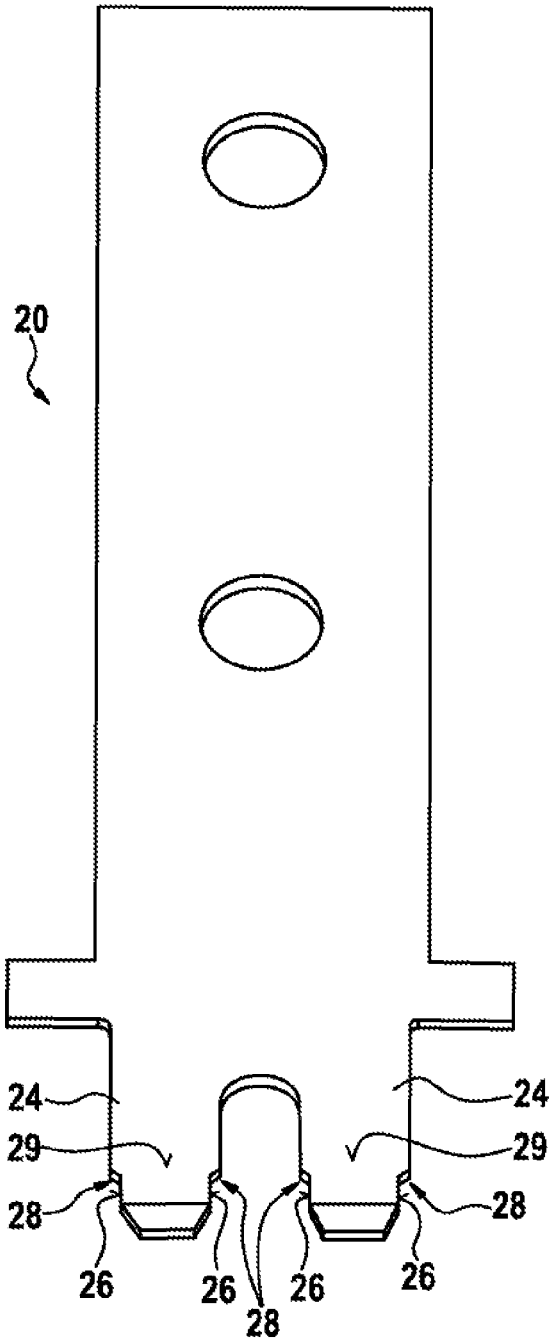
FIG. 3 shows a schematic perspective view of an exemplary embodiment of a contact terminal for the inventive high current contact pursuant to FIG. 1.
Figure 4:
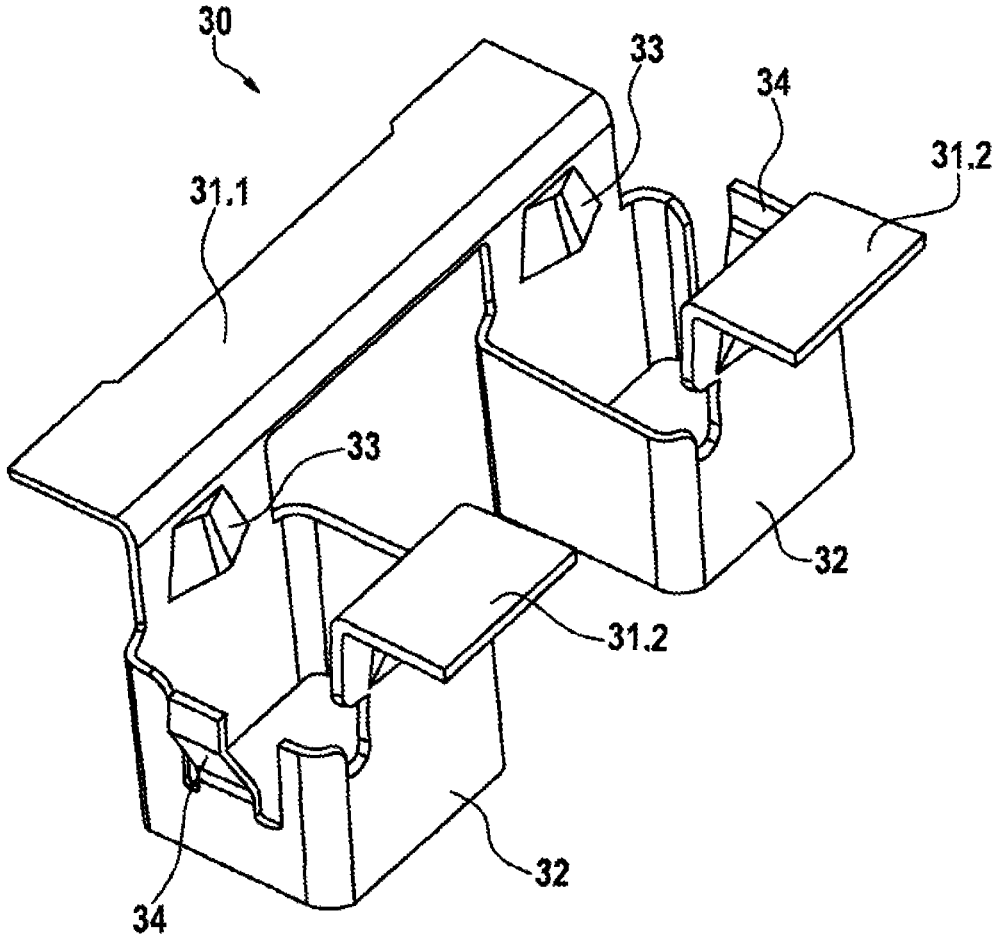
FIG. 4 shows a schematic perspective view of the exemplary embodiment of a contact pin for the inventive high current contact pursuant to FIG. 1.

As can further be seen particularly in FIGS. 2 and 3, the contact limbs 24 comprise in each case a plastically deformable seating shoulder 28 on two sides, which is supported in each case on the contact pin 10 at corresponding plastically deformable supporting surfaces 18, to produce the pressure contact 7. In addition, the contact limbs 24 have on two sides in each case a plastically deformable first contact surface 26, which in each case interacts with a corresponding plastically deformable second contact surface 16 of the contact opening 15. The geometry and/or material and/or material thickness of the plastically deformable components 18, 28, 16, 26 of the contact limbs 24 or the contact opening 15 are adapted to an electric current to be transmitted.

Figure 5:
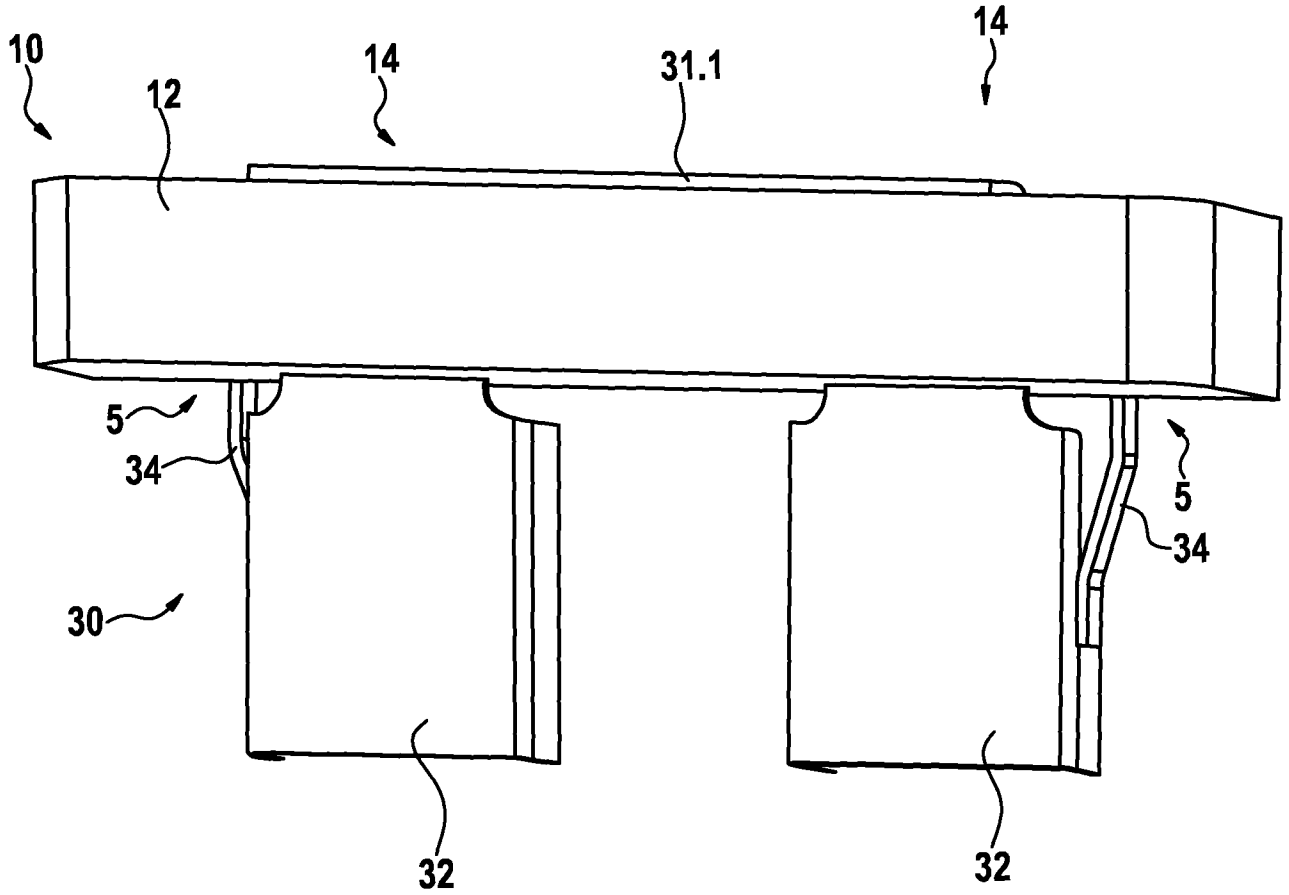
FIG. 5 shows a schematic perspective view from the side of an intermediate product during production of the inventive high current contact pursuant to FIG. 1.
Figure 6:
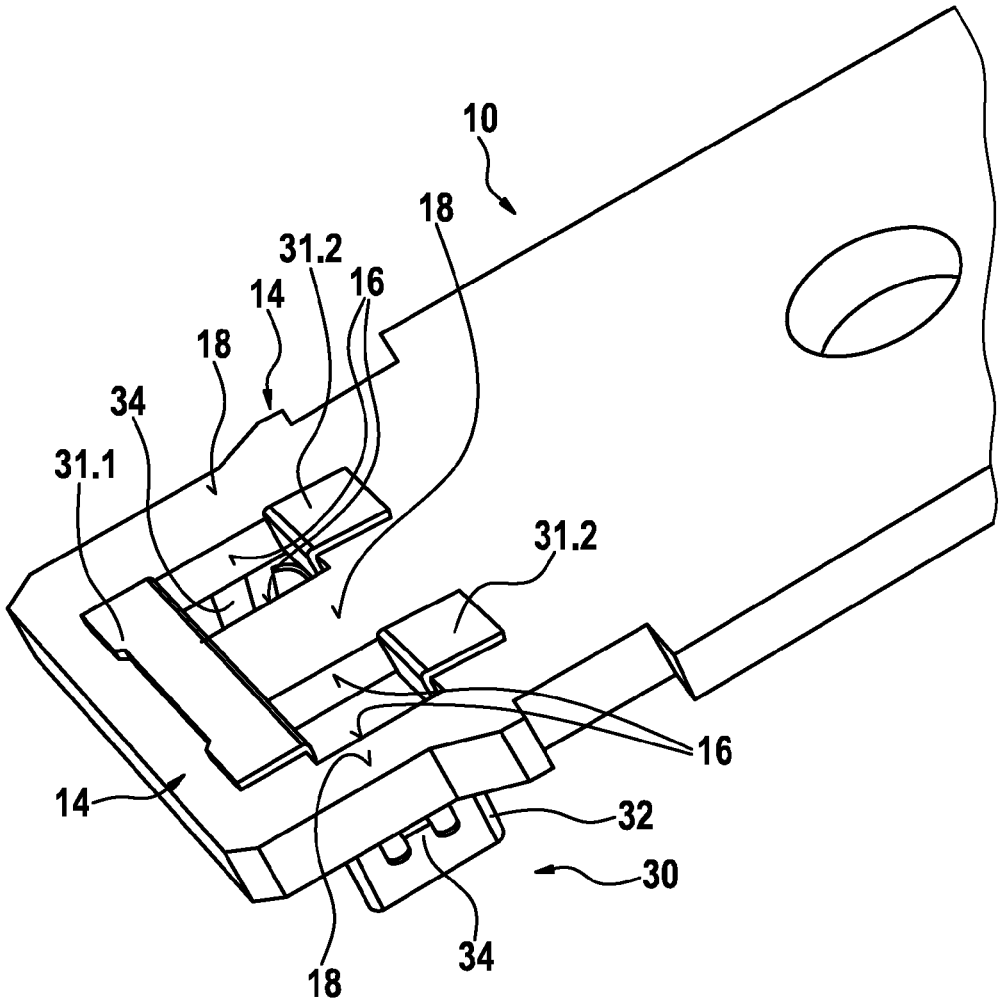
FIG. 6 shows a schematic perspective view from the top of the intermediate product during production of the inventive high current contact pursuant to FIG. 1.
Figure 7:
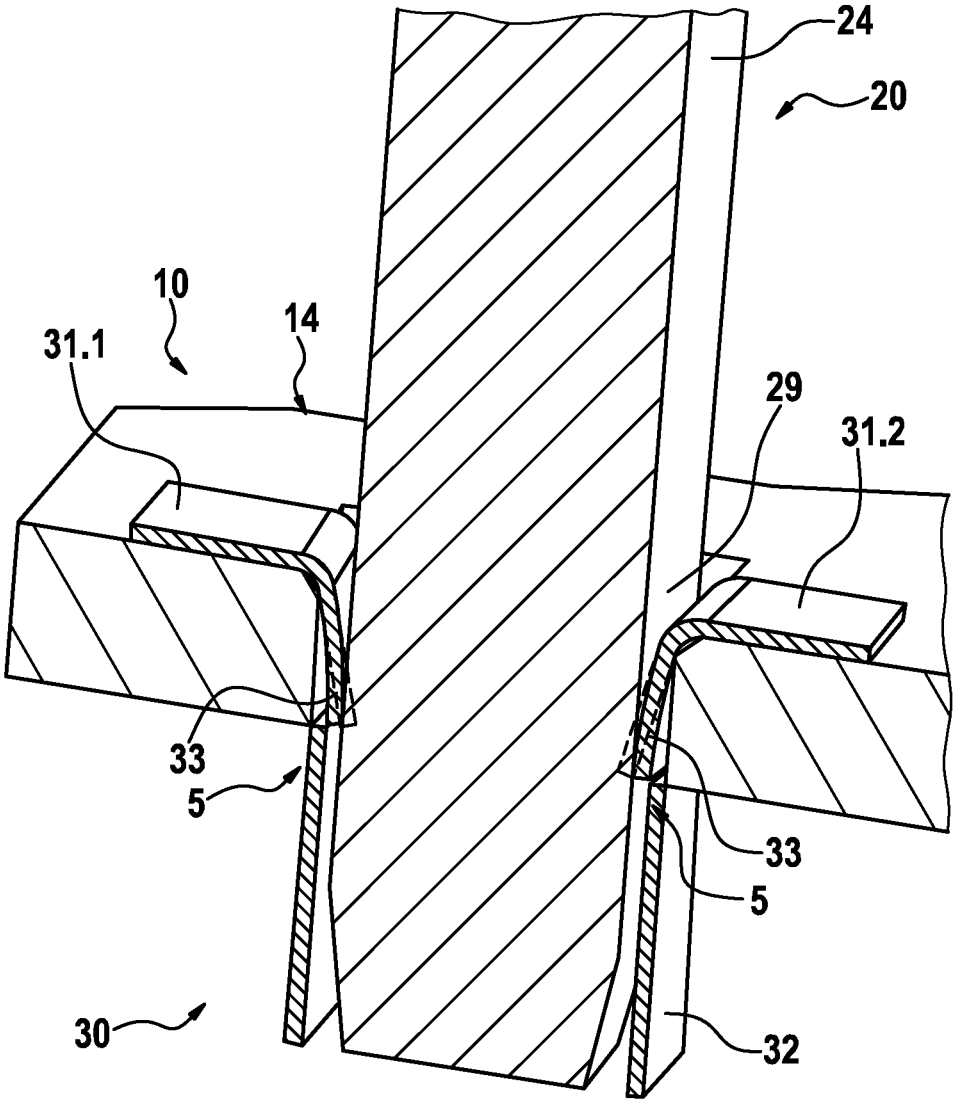
FIG. 7 shows a schematic perspective sectional view of the exemplary embodiment of the inventive high current contact pursuant to FIG. 1.

According to the inventive method for producing a high current contact 1 from the contact pin 10 comprising at least one contact opening 15 and the contact terminal 20 comprising at least one contact limb 24, the spring unit 30 comprising at least one base body 32 is first inserted into the at least one contact opening 15 of the contact pin 10; thus enabling the intermediate product depicted in FIGS. 5 and 6 to be formed. As can be seen in FIGS. 5 and 6, the spring unit 30 has several supporting collars 31.1, 31.2 which abut against the surface of the contact pin 10 on two edges of the contact openings 15, wherein a first supporting collar 31.1 connects the two base bodies 32 of the spring unit 30 to each other. On the other side of the contact pin 10, the spring unit 30 is supported on the edge of the contact openings 15 by means of the first spring elements 34; thus preventing the inserted spring unit 30 from drawing back out of the contact openings 15. After inserting the spring unit 30 into the contact openings 15 of the contact pin 10, the at least one contact limb 24 of the contact terminal 20 is press fitted on at least one joint region 14 into a corresponding contact opening 15 of the contact pin 10 to produce an electrical contact, wherein said spring unit 30 comprising at least one second spring element 33 grips into at least one contact surface 29 of the contact limb 24 when press fitting the at least one contact limb 24 into the contact opening 15. According to the invention, producing the electrical contact between the contact pin 10 and the contact terminal 20 is thereby largely separated from the receiving of mechanical forces because the electrical contact between the contact pin 10 and the contact terminal 20 is substantially produced by a first connection type, in this case by press fitting, and the mechanical forces are substantially received by a second connection type, namely by the spring unit 30, which is designed such that no inadmissible relative motions occur between the contact pin 10 and the contact terminal 20.

The inventive high current contact 1 can, for example, be used in pulse width modulated inverters for hybrid drives, DC to DC converters and control devices for wind power systems, solar energy systems and fuel cells.

Embodiments of the high current contact according to the invention can advantageously be used for the contacting of large cable cross sections while using any desired combinations of highly conductive metal materials, such as, for example, highly purified copper, silver or aluminum materials an/or the highly conductive alloys thereof, wherein in terms of processes, there is no restriction in the selection of the material partners and the surfaces thereof. In addition, embodiments of the inventive high current contact are capable of receiving large mechanical loads, which, for example, can result from thermal linear expansion or from vibrational loads. In embodiments of the inventive high current contact, the functions of electrical contacting and the receiving of mechanical forces are largely separate. The electrical contact is produced via a pressure contact, which occurs by means of plastic deformation of the partners to be contacted. The mechanical forces are received by the spring unit, which is designed such that no inadmissible relative motions can occur between the electrical contact surfaces.

The invention claimed is:

1. A high current contact comprising a contact pin (10), which has at least one contact opening (15), and a contact terminal (20), which has at least one contact limb (24), wherein the at least one contact limb (24) of the contact terminal (20) is connected to a corresponding contact opening (15) of the contact pin (10) on at least one joint region (14) to produce an electrical contact and to receive mechanical forces, characterized in that producing the electrical contact between the contact pin (10) and the contact terminal (20) is largely separate from the receiving of mechanical forces, wherein the electrical contact between said contact pin (10) and said contact terminal (20) is produced by a first connection type (7) and the mechanical forces are received by a second connection part (5), characterized in that the electrical contact between the contact pin (10) and the contact terminal (20) is produced by a pressure contact (7) between the at least one contact opening (15) of said contact pin (10) and the at least one contact limb (24) of said contact terminal (20), wherein the pressure contact (7) is produced by plastic deformations of at least one of the contact opening (15) and of the contact limb (24).

2. The high current contact according to claim 1, characterized in that the at least one contact limb (24) has in each case a plastically deformable seating shoulder (28) on two sides, said seating shoulders being supported on the contact pin (10) at corresponding plastically deformable supporting surfaces (18).

3. The high current contact according to claim 1, characterized in that the at least one contact limb (24) has in each case a plastically deformable first contact surface (26) on two sides, said first contact surfaces interacting with corresponding plastically deformable second contact surfaces (16) of the contact opening (15).

4. The high current contact according to claim 1, characterized in that at least one of the geometry, the material and the material thickness of the plastically deformable components (18, 28, 16, 26) are adapted to an electric current to be transmitted.

5. A high current contact comprising a contact pin (10), which has at least one contact opening (15), and a contact terminal (20), which has at least one contact limb (24), wherein the at least one contact limb (24) of the contact terminal (20) is connected to a corresponding contact opening (15) of the contact pin (10) on at least one joint region (14) to produce an electrical contact and to receive mechanical forces characterized in that producing the electrical contact between the contact pin (10) and the contact terminal (20) is largely separate from the receiving of mechanical forces, wherein the electrical contact between said contact pin (10) and said contact terminal (20) is produced by a first connection type (7) and the mechanical forces are received by a second connection part (5), characterized in that a spring unit (30), which comprises at least one base body (32) having at least one spring element (33, 34), for the receiving of the mechanical forces is inserted into the at least one contact opening (15).

6. The high current contact according to claim 5, characterized in that the spring unit (30) is embodied such that at least one first spring element (34) is designed as a support member which prevents the inserted spring unit (30) from drawing back out of the contact opening (15).

7. The high current contact according to claim 5, characterized in that the spring unit (30) is designed such that at least one second spring element (33) grips into at least one contact surface (29) of the contact limb (24) when press fitting said at least one contact limb (24) into the contact opening (15).

8. A method for producing a high current contact from a contact pin (10) having at least one contact opening (15) and a contact terminal (20) with at least one contact limb (24), the method comprising connecting the at least one contact limb (24) of the contact terminal (20) to a corresponding contact opening (15) of the contact pin (10) on at least one joint region (14) to produce an electrical contact and to receive mechanical forces, and producing the electrical contact between said contact pin (10) and said contact terminal (20) largely separately from the receiving of mechanical forces, wherein the electrical contact between said contact pin (10) and said contact terminal (20) is produced substantially by a first connection type and the mechanical forces are received substantially by a second connection type, characterized in that a spring unit (30), which comprises at least one base body (32) having at least one spring element (33, 34), for the receiving of the mechanical forces is inserted into the at least one contact opening (15), wherein the electrical contact between the contact pin (10) and the contact terminal (20) is produced by a pressure contact (7) between the at least one contact opening (15) of said contact pin (10) and the at least one contact limb (24) of said contact terminal (20).

* * * * *